US009669525B2

(12) United States Patent
Tsai

(10) Patent No.: US 9,669,525 B2
(45) Date of Patent: Jun. 6, 2017

(54) PALM WRENCH

(71) Applicant: Min-Hua Tsai, Taichung (TW)

(72) Inventor: Min-Hua Tsai, Taichung (TW)

( * ) Notice: Subject to any disclaimer, the term of this patent is extended or adjusted under 35 U.S.C. 154(b) by 333 days.

(21) Appl. No.: 14/619,086

(22) Filed: Feb. 11, 2015

(65) Prior Publication Data

US 2016/0229041 A1 Aug. 11, 2016

(51) Int. Cl.

| | |
|---|---|
| ***B25B 23/00*** | (2006.01) |
| ***B25B 13/46*** | (2006.01) |
| ***B25G 1/10*** | (2006.01) |
| ***B25G 1/06*** | (2006.01) |

(52) U.S. Cl.

CPC ..... *B25B 23/0028* (2013.01); *B25B 13/465* (2013.01); *B25G 1/066* (2013.01); *B25G 1/105* (2013.01)

(58) Field of Classification Search

CPC ... B25B 13/465; B25B 13/461; B25B 13/462; B25B 23/0028; B25G 1/066; B25G 1/105

See application file for complete search history.

(56) References Cited

U.S. PATENT DOCUMENTS

D255,979 S * 7/1980 Boursaw ..... 81/29
4,791,837 A * 12/1988 Main ..... B25B 13/00 81/177.1
5,005,448 A * 4/1991 Main ..... B25B 13/00 81/177.1
5,542,322 A * 8/1996 Knox ..... B25B 13/461 81/177.6
5,967,003 A * 10/1999 Lin ..... B25G 1/085 81/58.3
6,079,298 A * 6/2000 Gasperi ..... B25B 15/04 81/177.1
6,138,531 A * 10/2000 Lamons ..... B25B 13/461 81/58.1
6,976,408 B2 * 12/2005 Chen ..... B25B 13/463 81/58
7,168,345 B1 * 1/2007 Hsieh ..... B25G 1/063 411/403
7,182,003 B1 * 2/2007 Hsieh ..... B25G 1/063 411/403
7,509,892 B2 * 3/2009 Hsieh ..... B25B 13/461 81/177.6
7,878,091 B2 * 2/2011 Abel ..... B25B 13/461 81/177.9
2009/0205449 A1 * 8/2009 Chen ..... B25B 13/461 74/63
2013/0269491 A1 * 10/2013 Chang ..... B25B 23/16 81/177.8
2014/0013904 A1 * 1/2014 Meholovitch ..... B25B 13/463 81/63.2
2014/0060258 A1 * 3/2014 Anders ..... B25B 13/465 81/60
2016/0263736 A1 * 9/2016 Sun ..... B25B 13/465 81/63.1

* cited by examiner

*Primary Examiner* — David B Thomas

(57) ABSTRACT

A palm wrench includes a C-shaped body and a driving head. The driving head is pivotably and rotatably located within the body. The body has an opening, and the driving head has two function ends on two sides thereof. The driving head is pivotably connected to the body by two pivots which extend through the body and are connected to the driving head. The driving head can be rotated with respect to the body, and the user can grapes the body to rotate the driving head to output torque.

12 Claims, 10 Drawing Sheets

PALM WRENCH

BACKGROUND OF THE INVENTION

1. Fields of the Invention

The present invention relates to a wrench, and more particularly, to a palm wrench with a rotatable driving head rotatably and pivotably located in a C-shaped casing.

2. Descriptions of Related Art

The conventional palm wrench is disclosed in U.S. Pat. No. 6,976,408 which has an annular case with a ratchet unit which has a function end. The case has plate pivotably connected to the outside of the case so that the user can grape the case to operate the case. The case has a cover threadedly mounted to the top thereof to restrict the ratchet unit. However, the function end of the ratchet unit and the case can only be fixed on the same axis so that the function end cannot be adjusted angularly relative to the case.

The present invention intends to provide a palm wrench which eliminates the shortcomings mentioned above.

SUMMARY OF THE INVENTION

The present invention relates to a palm wrench including a C-shaped body and a driving head pivotably and rotatably located within the body. The body has an opening at one end, and the driving head has two function ends on two sides. The driving head is pivotably connected to the body by two pivots which extend through the body and are connected to the driving head. The user grapes the body to rotate the driving head to output torque.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
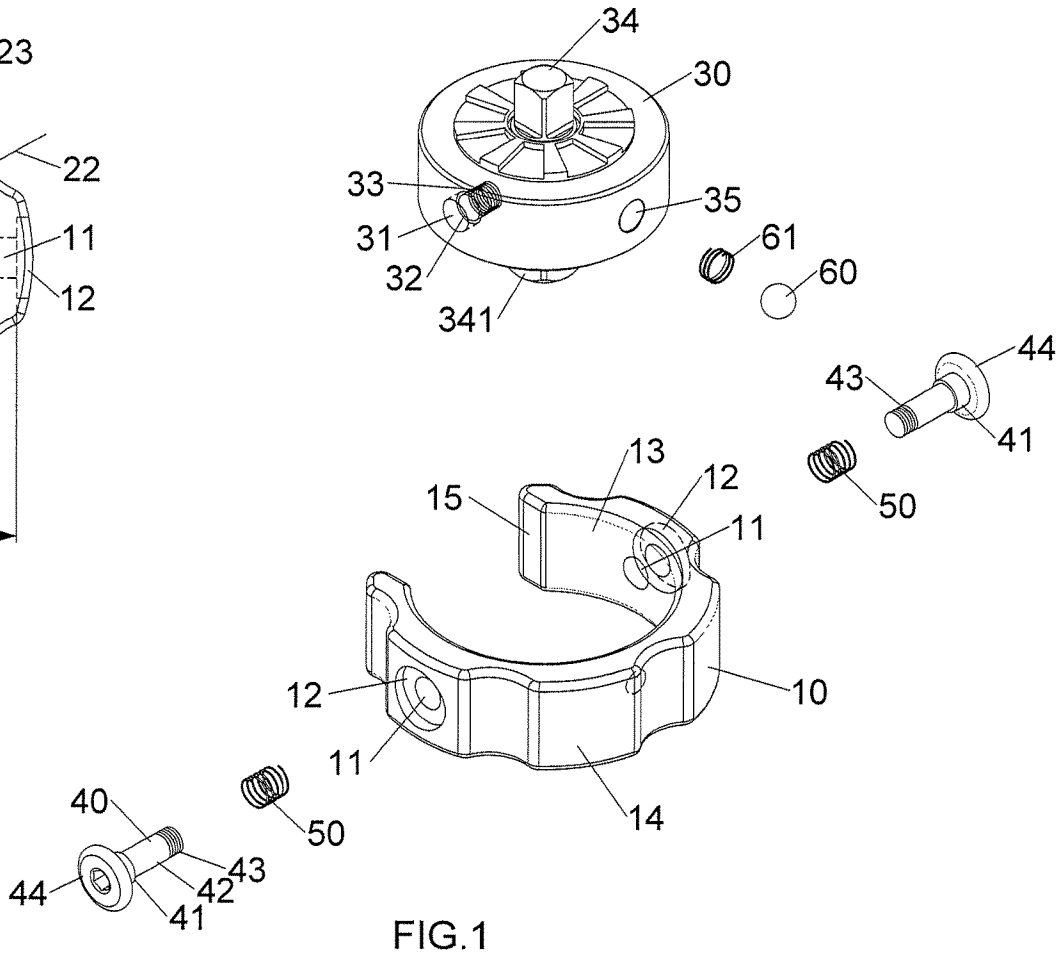
FIG. 1 is an exploded view of the palm wrench of the present invention.
Figure 2:
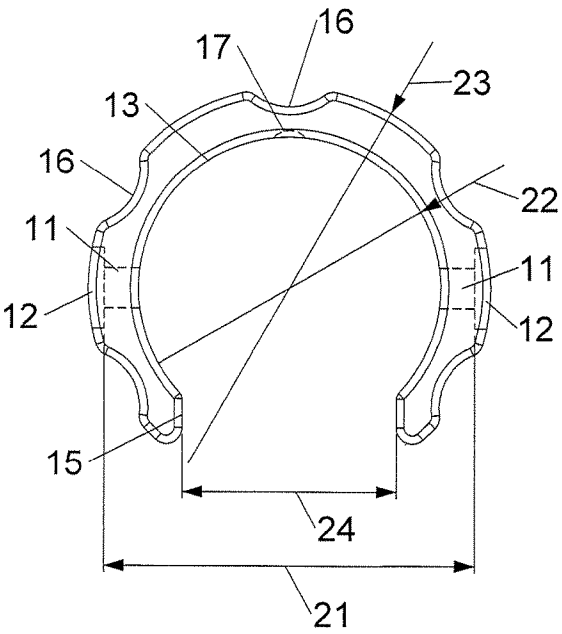
FIG. 2 is a top view of the body of the palm wrench of the present invention.
Figure 3:
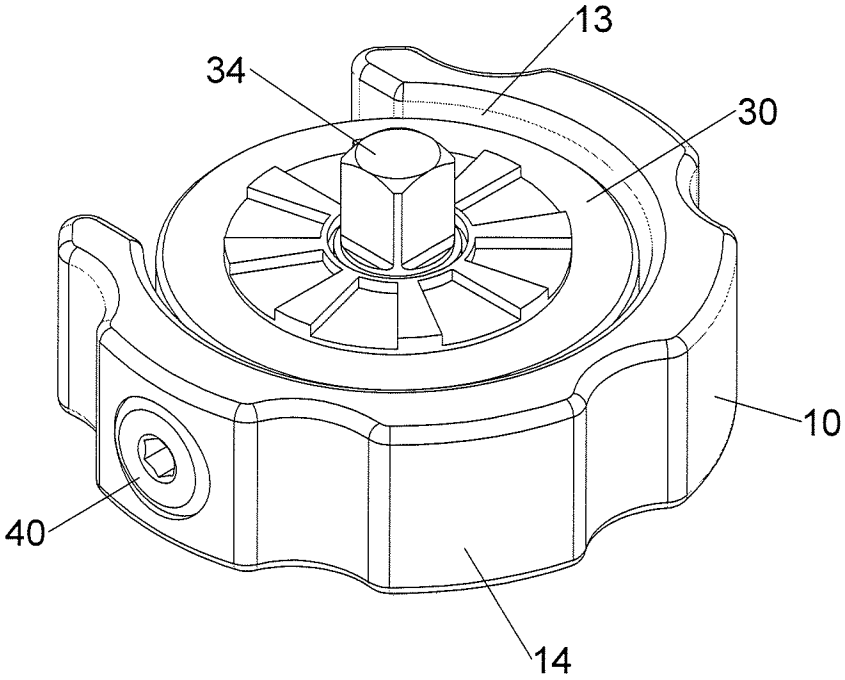
FIG. 3 is a perspective view to show the palm wrench of the present invention.
Figure 6:
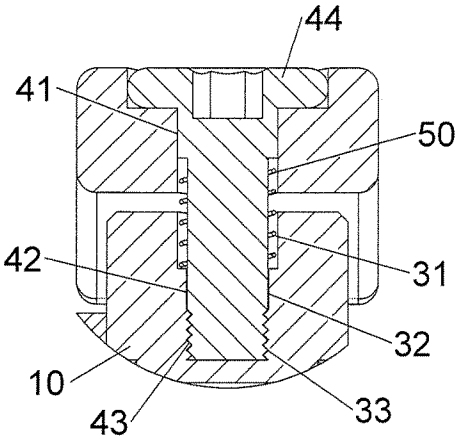
FIG. 6 is an enlarged view of the circled B in FIG. 5.
Figure 5:
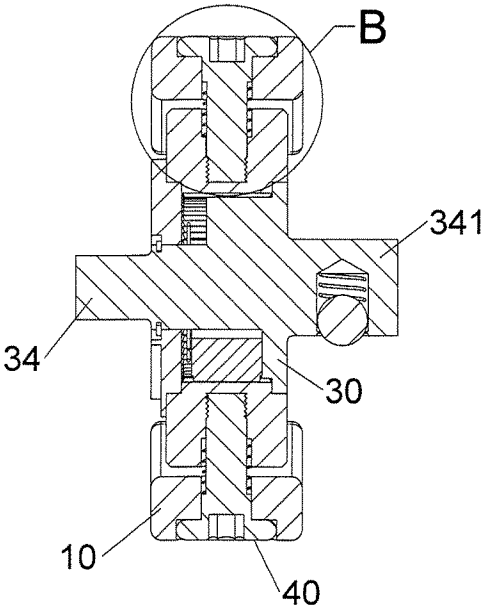
FIG. 5 is a cross sectional view, taken along line A-A in FIG. 4.
Figure 4:
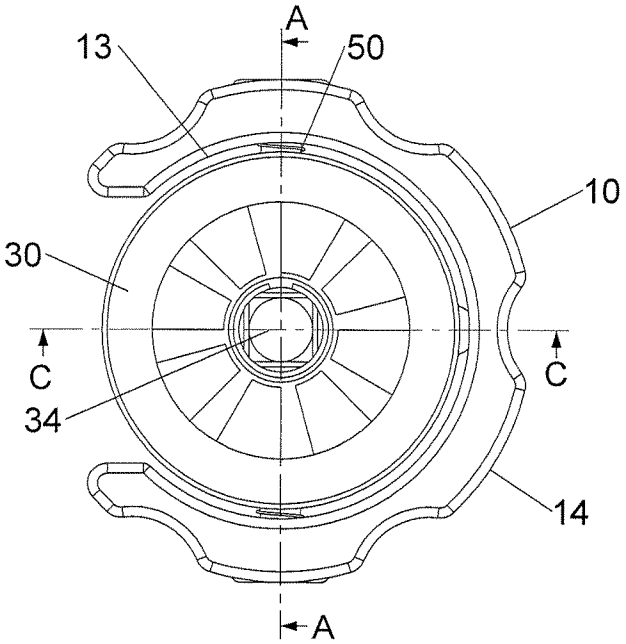
FIG. 4 is a top view of the palm wrench of the present invention.
Figure 7:
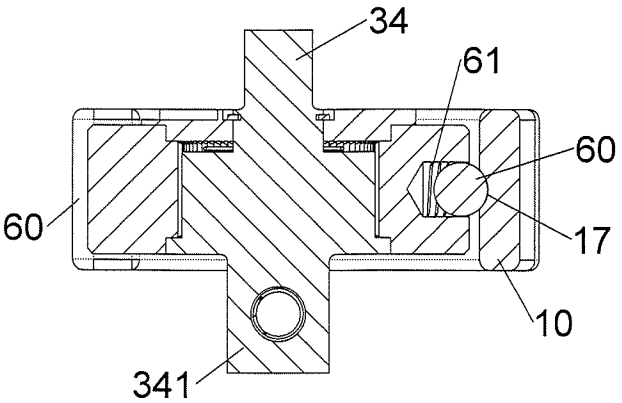
FIG. 7 is a cross sectional view, taken along line C-C in FIG. 4.

Referring to FIGS. 1 to 8, the palm wrench the of the present invention comprises a C-shaped body 10, a driving head 30, two pivots 40, two first resilient members 50, a first bead 60 and a second resilient member 61. The body 10 includes an inner periphery 13 and an outer periphery 14, and has an opening 15. A dent 17 is defined in the inner periphery 13 of the body 10. Two apertures 11 are respectively and diametrically defined in the inner periphery 13 of the body 10. Each aperture 11 communicates with a sink hole 12 defined in the outer periphery 14 of the body 10. A line between the center of the opening 15 and the center of the dent 17 is perpendicular to the line between two respective centers of the two apertures 11. Multiple notches 16 are defined in the outer periphery 14 of the body 10 so that the user can easily grape the body 10. The gap 21 is defined as the distance between the two outer ends of the two apertures 11. The outer diameter 23 of the body 10 is between 45 mm to 75 mm. The distance of the gap 21 is larger than the inner diameter 22 of the inner periphery 13 of the body 10, but is less than the outer diameter 23 of the outer periphery 14 of the body 10. The ratio between the width 24 of the opening 15 and the inner diameter 22 of the inner periphery 13 of the body 10 is 0.5:1 to 0.9:1, preferably, 0.6:1 to 0.8:1. The best ratio is 0.7:1.

The driving head 30 has two pivotal holes 31 defined diametrically therein. The diameter of the pivotal holes 31 is the same as that of the apertures 11. The outer diameter of the driving head 30 is smaller than the inner diameter 22 of the inner periphery 13 of the case 10. Each pivotal hole 31 co-axially communicates with a passage 32 which has inner threads 33 defined therein. The driving head 30 has a first function end 34 and a second function end 341 on two ends thereof. The first function end 34 and the second function end 341 each are rectangular protrusions of different sizes so as to be connected with a socket, an adapter or an extension rod. The driving head 30 has at least one first hole 35 defined in the outer periphery thereof and the at least one first hole 35 is located corresponding to the dent 17.

The two pivots 40 each have a head 44, a stem 41 extending from the head 44 and a shank 42 extending from the stem 41. The stem 41 has outer threads 43 defined in the outer periphery thereof. Each pivot 40 extends through the aperture 11 with the stem 41 loosely extending through the aperture 11. The shank 42 extends through the pivotal hole 31 and the passage 32. The outer threads 43 are threadedly connected to the inner threads 33. The head 44 is accommodated in the sink hole 12. The driving head 30 is rotatable about the two pivots 40 relative to the body 10.

The two first resilient members 50 such as springs, are respectively located in the two apertures 11 of the body 10 and the pivotal hole 31 of the driving head 30. The two first resilient members 50 are respectively mounted to the two shanks 42 of the two pivots 40 so as to be biased between the inner end of the pivotal hole 31 and the stem 41. The two first resilient members 50 and the two pivots 40 are located symmetrically to the center of the driving head 30.

The first bead 60 and the second resilient member 61 are located in the at least one first hole 35. The first bead 60 is biased by the second resilient member 61 so as to be engaged with the dent 17 to position the driving head 30 relative to the body 10.

Figure 8:
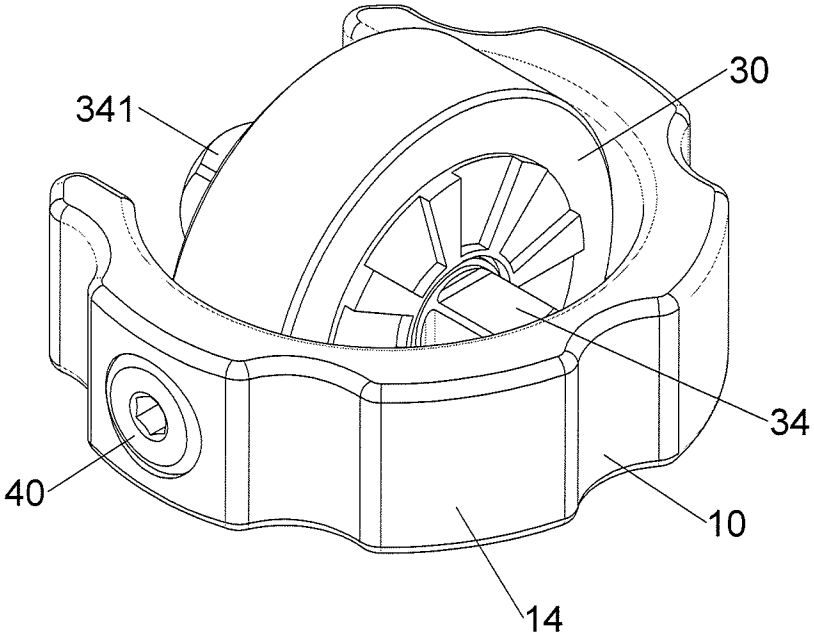
FIG. 8 shows that the driving head is rotated relative to the body of the palm wrench of the present invention.

As shown in FIG. 8, the driving head 30 is rotated about the two pivots 40 so as to be positioned to make the axis of the driving head 30 and the axis of the body 10 be perpendicular to each other, and the second function end 341 is located corresponding to the opening 15.

Figure 9:
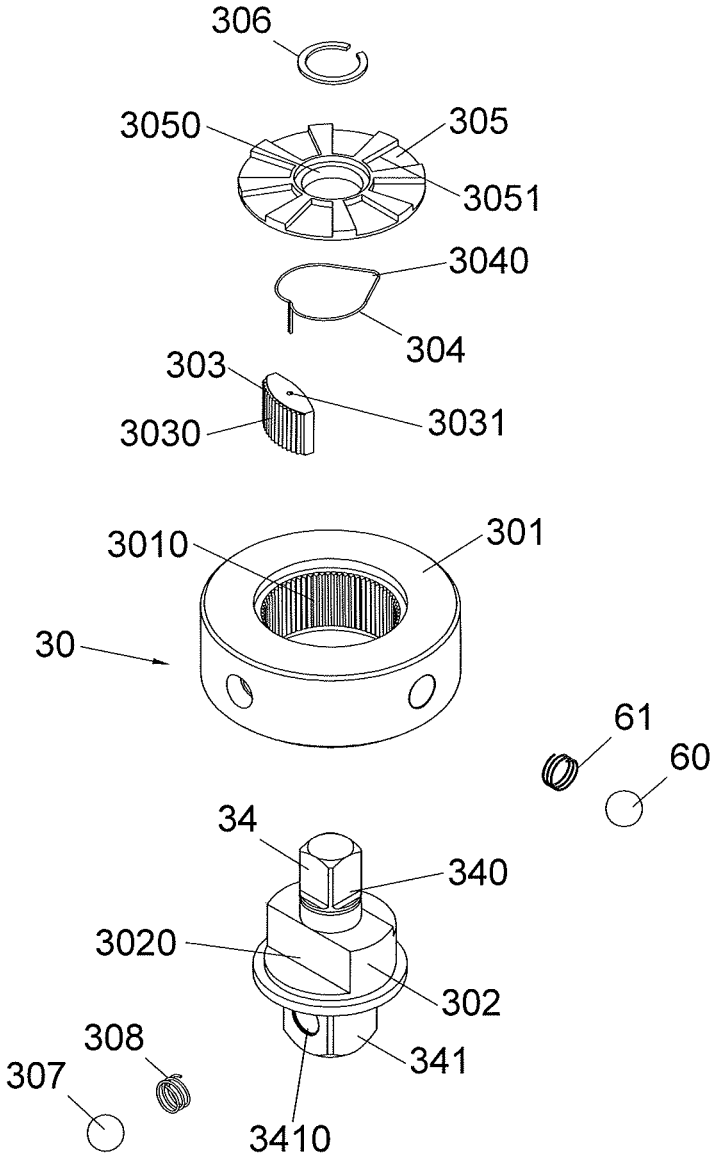
FIG. 9 is an exploded view of the driving head of the palm wrench of the present invention.

As shown in FIG. 9, the driving head 30 comprises a casing 301, a rotational member 302, a pawl 303, a third resilient member 304, a disk 305, a clip 306, a second bead 307 and a fourth resilient member 308. The casing 301 is a ring like member and has ratchet teeth 3010 defined in the inner periphery thereof. The pivotal holes 31, the passages 32, and the at least one first holes 35 are located on the outer periphery of the casing 301. The rotational member 302 is rotatably located in the casing 301, wherein the first and second function ends 34, 341 are respectively formed on the rotational member 302. The first function end 34 has a groove 340 and the second function end 341 has a second hole 3410. A semi-circular recess 3020 is defined in the rotational member 302. The pawl 303 is located in the recess 3020 and within the casing 301. The pawl 303 has engaging teeth 3030 defined in one side thereof so as to be engaged with the ratchet teeth 3010. The pawl 303 has an insertion hole 3031 defined in the top thereof. The third resilient member 304 is a heart-shaped member which has a tip end 3040 and an insertion end which is formed by two ends of the third resilient member 304. The third resilient member 304 is mounted to the first function end 34 and the insertion end is inserted into the insertion hole 3031 of the pawl 303. The disk 305 is connected to the casing 301 and has a central hole 3050 through which the first function end 34 extends. The disk 305 has multiple ribs 3051 on the top thereof, and the tip end 3040 of the third resilient member 304 engaged with one of the ribs 3051. The clip 306 is engaged with the groove 340. The second bead 307 and the fourth resilient member 308 are located in the second hole 3410. The second bead 307 is biased by the fourth resilient member 308 which is a spring. The disk 305 is rotatable about the rotational member 302 so as to drive the third resilient member 304 to move the pawl 303 within the recess 3020, therefore, the driving head 30 is controlled to be rotated in clockwise or counter clockwise.

Figure 10:
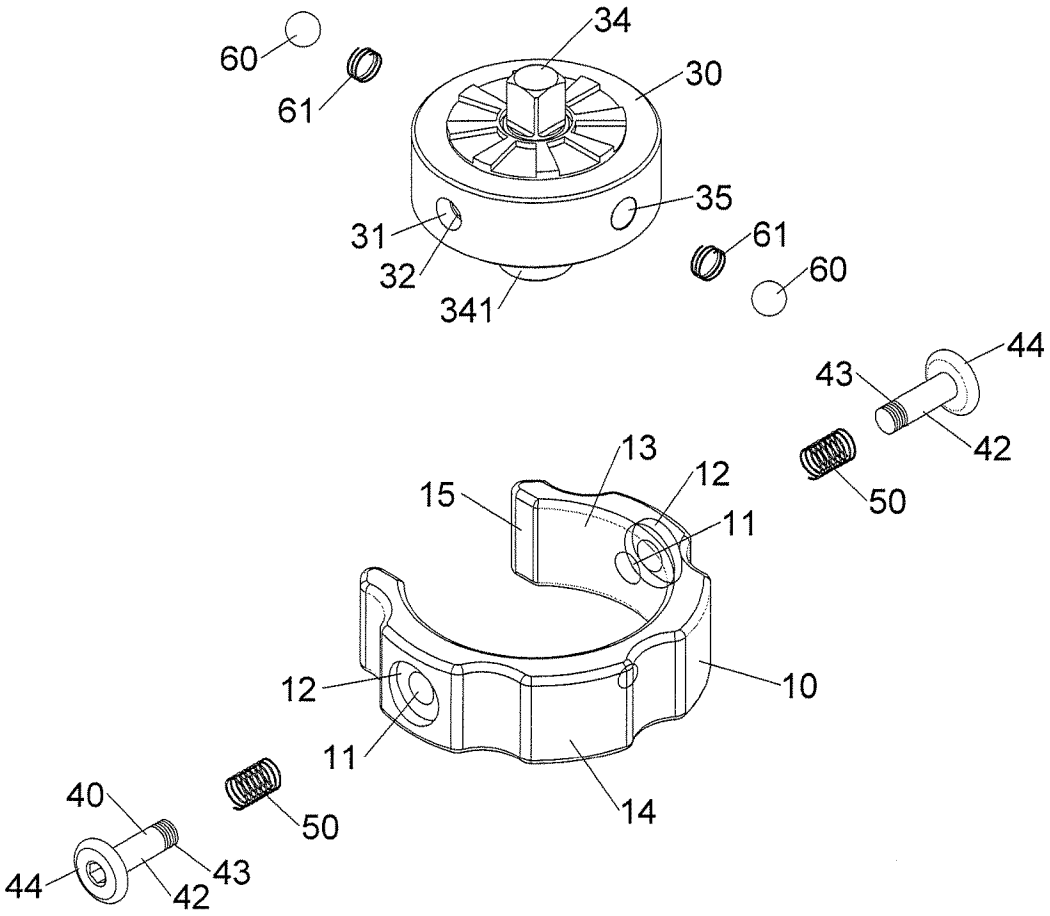
FIG. 10 is an exploded view of the second embodiment of the palm wrench of the present invention.

As shown in FIG. 10, the driving head 30 has two first holes 35, when the driving head 30 is rotated relative to the apertures 11. Each first hole 35 receives a first bead 60 and a second resilient member 61 therein. One of the first holes 35 is located corresponding to the opening 15 and the other one of the first holes 35 is located corresponding to the dent 17. The pivots 40 do not have the stem 41.

Figure 13:
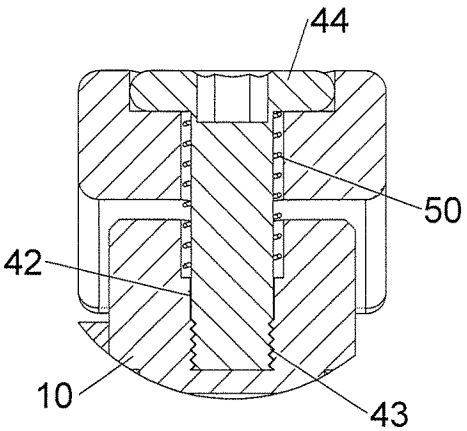
FIG. 13 is an enlarged view of the circled B in FIG. 12.
Figure 12:
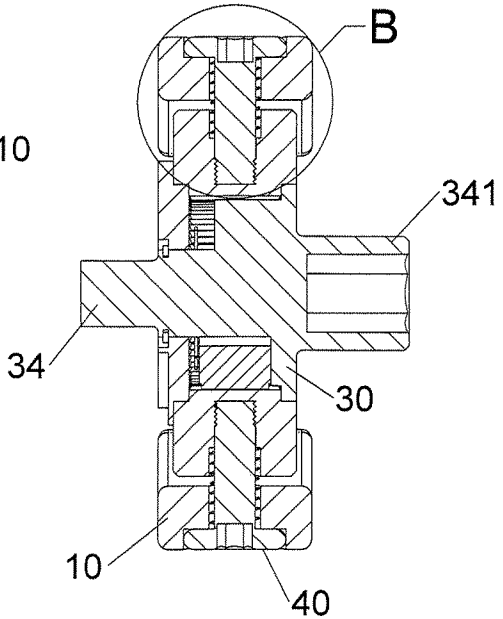
FIG. 12 is a cross sectional view, taken along line A-A in FIG. 11.
Figure 11:
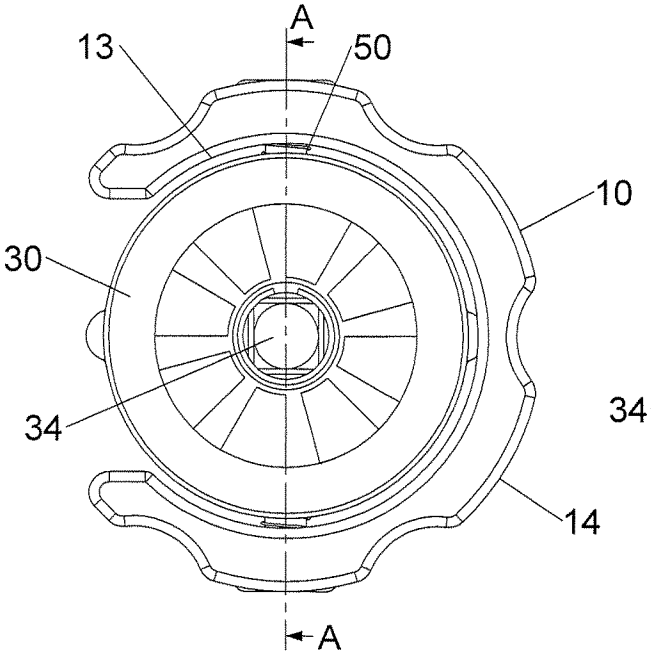
FIG. 11 is a top view of the palm wrench of the present invention in FIG. 10.

FIGS. 11 to 13 show that the second function end 341 is a hexagonal recess. The pivots 40 do not have the stem 41.

Figure 14:
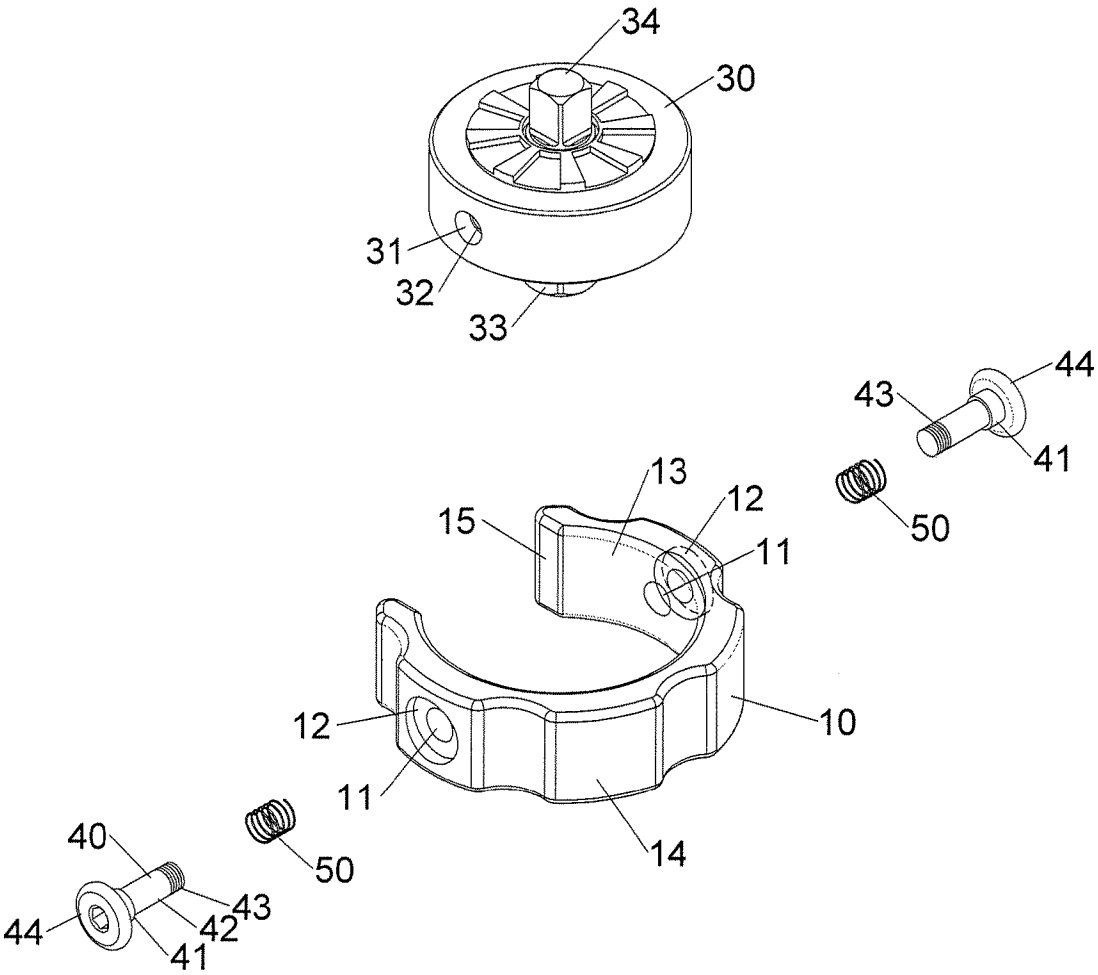
FIG. 14 is an exploded view of the third embodiment of the palm wrench of the present invention, and FIG. 15 a top view of the palm wrench of the present invention in FIG. 14.

As shown in FIG. 14, there is no dent 17, the first hole 35, the first bead 60 and the second resilient member 61. The driving head 30 cannot be position when the driving head 30 is rotatable relative to the body 10.

Figure 15:
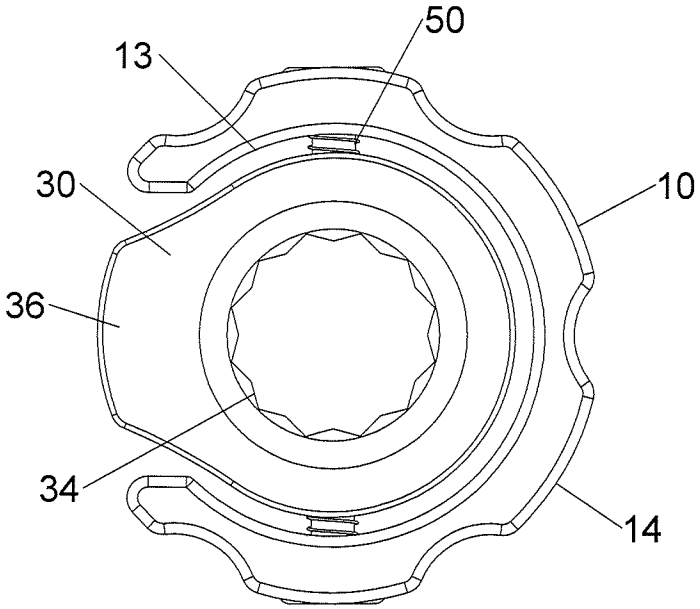

As shown in FIG. 15, the first function end 34 is a polygonal recess. The driving head 30 has a handle 36 which is located in the opening 15.

The driving head 30 can be operated at any angle relative to the body 10. When the driving head 30 is rotated at an 90 degree position relative to the body 10, the second function end 341 faces the opening 15, the outer periphery 14 and the outer periphery of the driving head 30 are normal to each other so that the user can easily operate the wrench. The pivots 40 each have a stem 41 and a shank 42, the stem 41 is located in the aperture 11, and the shank 42 is located in the passage 32, so that the pivots 40 are well positioned. The driving head 30 can be positioned by engaging the first bead 60 with the dent 17. In one embodiment, there are two first holes 35 and each first hole 35 has a first bead 60 and a second resilient member 61, so that the driving head 30 can be positioned relative to the body 10 in two directions. The first and second function ends 34, 341 allow different tools to be connected with the palm wrench of the present invention. Furthermore, the opening 15 can accommodate the handle 36 of the driving head 30 or an H-shaped driving head.

While we have shown and described the embodiment in accordance with the present invention, it should be clear to those skilled in the art that further embodiments may be made without departing from the scope of the present invention.

What is claimed is:

1. A palm wrench comprising: a C-shaped body having an opening, a dent defined in an inner periphery of the body, two apertures respectively and diametrically defined in the inner periphery of the body, each aperture communicating with a sink hole defined in an outer periphery of the body, a line between a center of the opening and a center of the dent being perpendicular to a line between two respective centers of the two apertures, multiple notches defined in the outer periphery of the body, an outer diameter of the body being less than or equal to 75 mm; a driving head having two pivotal holes defined diametrically therein, an outer diameter of the driving head being smaller than an inner diameter of the inner periphery of the case, each pivotal hole coaxially communicating with a passage which has inner threads defined therein, the driving head having a first function end and a second function end on two ends thereof, the driving head having at least one hole defined in an outer periphery thereof and the at least one hole located corresponding to the dent; two pivots each having a head, a stem extending from the head and a shank extending from the stem, the stem having outer threads defined in an outer periphery thereof, each pivot extending through the aperture with the stem loosely extending through the aperture, the shank extending through the pivotal hole and the passage, the outer threads being threadedly connected to the inner threads, the head being accommodated in the sink hole, the driving head being rotatable about the two pivots relative to the body; two first resilient members respectively located in the two apertures of the body and the pivotal hole of the driving head, the two first resilient members respectively mounted to the two shanks of the two pivots so as to be biased between an inner end of the pivotal hole and the stem, the two first resilient members and the two pivots are located symmetrically to a center of the driving head, and at least one first bead and at least one second resilient member located in the at least one hole, the at least one first bead being biased by the at least one second resilient member so as to be engaged with the dent to position the driving head relative to the body.

2. The palm wrench as claimed in claim 1, wherein the outer diameter of the body is less than or equal to 65 mm.

3. The palm wrench as claimed in claim 1, wherein the outer diameter of the body is 45 mm to 55 mm.

4. The palm wrench as claimed in claim 1, wherein a ratio between a width of the opening and the inner diameter of the inner periphery of the body is 0.5:1 to 0.9:1.

5. The palm wrench as claimed in claim 1, wherein a ratio between a width of the opening and the inner diameter of the inner periphery of the body is 0.6:1 to 0.8:1.

6. The palm wrench as claimed in claim 1, wherein a ratio between a width of the opening and the inner diameter of the inner periphery of the body is 0.7:1.

7. The palm wrench as claimed in claim 1, wherein the first function end and the second function end each are rectangular protrusions of different sizes.

8. The palm wrench as claimed in claim 1, wherein the pivots each are a bolt, the two first resilient members each are a spring.

9. The palm wrench as claimed in claim 1, wherein the driving head comprises a casing, a rotational member, a pawl, a third resilient member, a disk, a clip, a second bead and a fourth resilient member, the casing is a ring and having ratchet teeth defined in an inner periphery thereof, the pivotal holes, the passages, and the at least one first holes are located on the outer periphery of the casing, the rotational member is rotatably located in the casing, the first and second function ends are respectively formed on the rotational member, the first function end has a groove and the second function end has a second hole, a recess is defined in the rotational member, the pawl is located in the recess and within the casing, the pawl has engaging teeth defined in one side thereof so as to be engaged with the ratchet teeth, the pawl has an insertion hole defined in a top thereof, the third resilient member is a heart-shaped member which has a tip end and an insertion end which is formed by two ends of the third resilient member, the third resilient member is mounted to the first function end and the insertion end is inserted into the insertion hole of the pawl, the disk is connected to the casing and has a central hole through which the first function end extends, the disk has a rib on a top thereof, the tip end of the third resilient member engaged with the rib, the clip is engaged with the groove, the second bead and the fourth resilient member are located in the second hole.

10. The palm wrench as claimed in claim 1, wherein the driving head has two first holes, each first hole receives a bead and a second resilient member therein, one of the first holes is located corresponding to the opening and the other one of the first holes is located corresponding to the dent.

11. The palm wrench as claimed in claim 1, wherein the second function end is a hexagonal recess.

12. The palm wrench as claimed in claim 1, wherein the first function end is a polygonal recess, the driving head has a handle which is located in the opening.

* * * * *